United States Patent [19]

Howard

[11] 4,120,594

[45] Oct. 17, 1978

[54] CORRECTION DEVICE FOR TYPEWRITERS AND THE LIKE

[75] Inventor: Robert Howard, Windham, N.H.

[73] Assignee: Centronics Data Computer Corp., Hudson, N.H.

[21] Appl. No.: 765,627

[22] Filed: Feb. 4, 1977

[51] Int. Cl.[2] ..... B41J 29/36

[52] U.S. Cl. ..... 400/697; 427/140

[58] Field of Search ..... 197/181; 239/289; 427/140, 421, 427

[56] References Cited

U.S. PATENT DOCUMENTS

| | | | |
|---|---|---|---|
| 1,423,290 | 7/1922 | Zeller | 197/181 X |
| 3,756,514 | 9/1973 | Brown | 239/337 |
| 3,788,442 | 1/1974 | Lehnhardt et al. | 197/181 |

FOREIGN PATENT DOCUMENTS

| | | | |
|---|---|---|---|
| 2,148,124 | 4/1973 | Fed. Rep. of Germany | 197/181 |
| 2,427,092 | 12/1975 | Fed. Rep. of Germany | 197/181 |

*Primary Examiner*—Paul T. Sewell

*Attorney, Agent, or Firm*—Lerner, David, Littenberg & Samuel

[57] ABSTRACT

A correction device for typewriters and the like, including a material, preferably in liquid form, maintained at a predetermined pressure within a container. The container outlet is coupled through a narrow elongated tube whose dispensing end is positioned upon the typewriter carriage or other device so as to be located immediately across from the last printed character or other symbol. An operating switch activates an electronic circuit for dispensing a measured amount of the material over the last printed character, the color of said material being the same as the paper being printed upon to provide the same effect as erasure of the character. The dispensing of the measured dosage may be accomplished either by electronic or mechanical means. The erasure means may be provided as an integral part of the typewriter unit or as an independent stand-alone accessory.

2 Claims, 12 Drawing Figures

FIG. 3b.
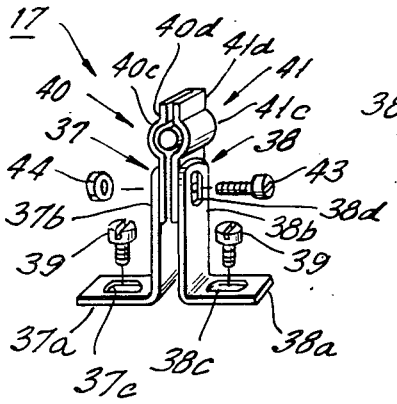
FIG. 3c.
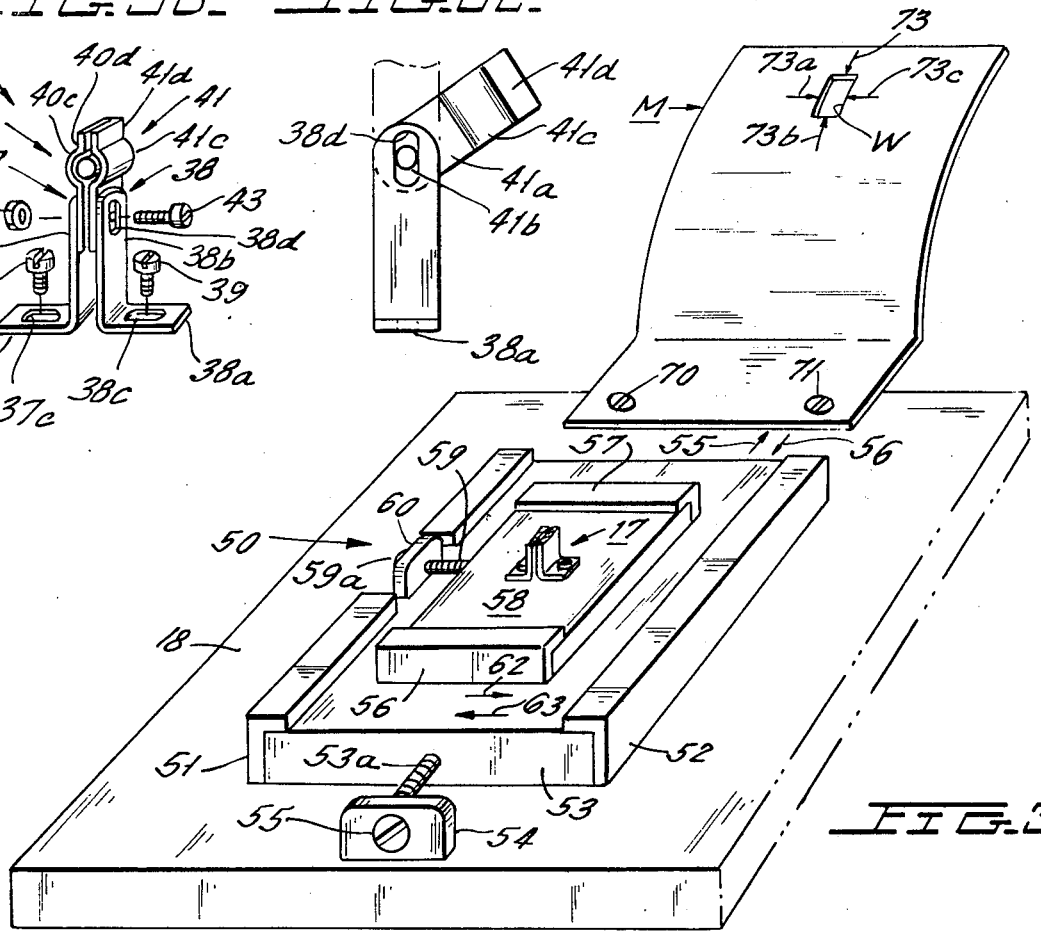
FIG. 3a.
FIG. 5a.
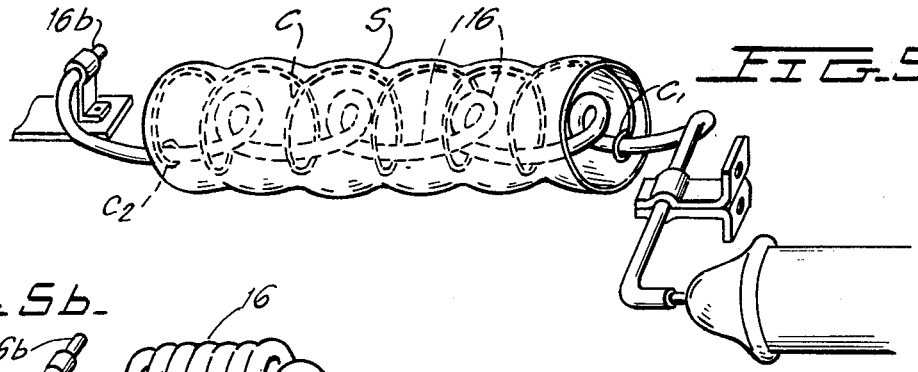
FIG. 5b.
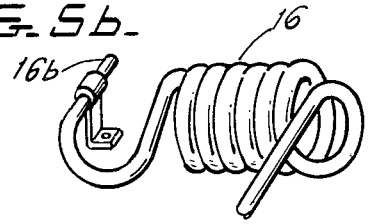
FIG. 5c.
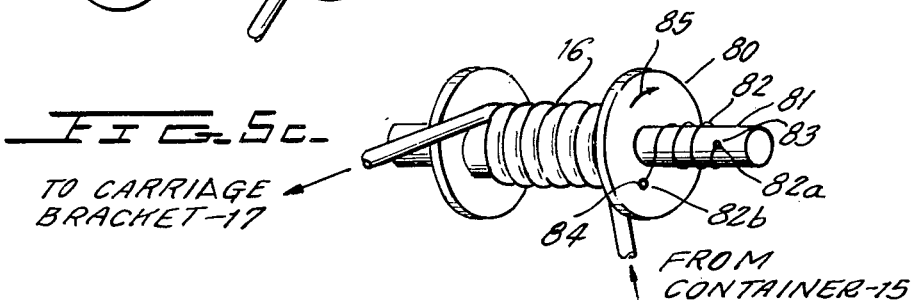

CORRECTION DEVICE FOR TYPEWRITERS AND THE LIKE

BACKGROUND OF THE INVENTION

The desirability of providing automatic erasure in typewriters, printers and the like has recently become a practical reality. One of the present day approaches is the provision of an additional tape or ribbon provided on one surface with an adhesive material. When it is desired to remove an incorrect character which may have been erroneously printed, a separate mechanism or key is activated to move the conventional inked ribbon away from the normal printing position, move the "erasure" (i.e. correction) ribbon or tape into the print position, back-space the carriage to permit printing to occur at the position of the erroneously printed character and finally, the appropriate "wrong" character key is depressed or a character code is generated, if remote operation is being undertaken, whereupon the same erroneous character is impacted first against the "erasure" tape and then against the paper so that the character in the form of the ink transferred to the paper sheet is pulled away from the paper to thereby cause an operation which is equivalent to conventional erasure. The adhesive strip must be held taut across the printing position so as to pull away from the paper when the type is returned to its non-print position.

In another conventional technique a card having a powder of a color the same as the paper sheet is manually positioned next to the paper sheet after the typewriter is backspaced to the proper position. The key of the "wrong" character is then depressed to impact the card and transfer the powder to the paper and upon the ink previously transferred to the paper.

The drawbacks of the above techniques are obvious in that, in the latter technique, the number of operations required are rather cumbersome and require manual activity. The printing of the incorrect character in "white" over the original printing of the incorrect character may be less than complete or otherwise imperfect so as to permit a portion or portions of the "black" incorrect character to nevertheless remain visible, resulting in a rather unattractive finished document. The mechanical manipulations of the former technique and the mechanisms which must be shifted and which hold the adhesive tape taut are also rather cumbersome. In addition, the adhesive also pulls the paper and may cause tearing.

BRIEF DESCRIPTION OF THE INVENTION

The present invention overcomes all of the cumbersome disadvantages of the prior art and is characterized by comprising a reservoir or container of the correction material utilized for the erasure operation at a predetermined pressure level. One preferred approach is the utilization of a pressurized or aerosol type container having valve means which, when depressed, dispenses the correction material in spray form. A slender, preferably plastic tubular member leads from the dispensing valve to a carriage means having a suitable adjustable bracket provided with manually operable adjustment means for supporting and positioning the outlet end of the tube adjacent the printer platen so as to dispense in spray form an amount of material sufficient to cover the erroneously printed character. The outlet end of the tube may have a rectangular cross-section generally conforming to the shape of the region in which any of the possible characters capable of being printed is formed. In addition to or as an alternative to such shape, the carriage means may further be provided with a mask positioned substantially immediately adjacent to the platen so as to permit the correction material to strike only that region within the window of the mask causing the region to be coated to be substantially well defined by the aforesaid window opening.

The dispensing end of the tube may be positioned at an oblique angle relative to the surface of the paper document so as to avoid the need for any back shifting of the dispensing end of the tube, as well as avoiding the need for any shifting of the print head or conventional inked ribbon, thus reducing the amount of elements activated during such an erasure operation thereby greatly simplifying the performance of an erasure operation.

This technique thus enables the erasure to take place without the necessity for impacting a type font or dot forming print heads, activating a jet printer means, or the like and since the entire substantially rectangular shaped cross-sectional area is covered with the correction material, there is no possibility of creating any imperfect covering of the erroneously printed character.

Preferably a measured dosage of the material is dispensed which may take the form of electronic means for activating the aerosol can valve into the dispensing position for a predetermined time interval whereupon release of the spray head button terminates the dispensing operation.

Alternatively, a mechanical means may be provided as part of the aerosol dispenser itself wherein the spray button and head is depressed and is caused to dispense a measured dosage due to the mechanical mechanism employed as part of the aerosol unit regardless of the length of time or differences in length of time during which the dispensing spray button is depressed.

In one preferred embodiment the correction unit is integrated into the printer housing.

As an alternative measure, the correction unit may be designed as a stand-alone device manually manipulated by the operator, in which case the mechanical dispenser controlling measured dosages is the preferred design.

OBJECTS OF THE INVENTION

It is therefore one object of the present invention to provide a novel erasure means for typewriters, printers, and the like, wherein erasure is accomplished by spraying the erroneously printed character or characters with a measured amount of correction material.

Another object of the present invention is to provide an erasure unit of the type described, wherein the material dispensed is of a color which is substantially the same as the paper being printed upon.

Still another object of the present invention is to provide an erasure mechanism of the character described hereinabove, wherein the material is dispensed from a pressurized container which preferably may be an aerosol container.

Another object of the present invention is to provide an erasure device of the type described hereinabove wherein the amount of spray dispensed is controlled by either mechanical or electronic means.

BRIEF DESCRIPTION OF THE FIGURES

The above, as well as other objects of the present invention will become apparent when reading the accompanying description and drawings in which:

FIG. 3*a* shows a perspective view of a portion of the carriage of FIG. 2 showing one mechanical adjustment means and a mask employed in the erasure apparatus.

FIGS. 3*b* and 3*c* show perspective and side elevational views of the holding bracket for the dispensing tube.

FIGS. 5*a* and 5*b* show perspective views of one tube arrangement employed in the correction device of FIG. 1, for example.

FIG. 5*c* is a perspective view of another tube arrangement which may be employed in place of that shown in FIGS. 5*a* and 5*b*.

DETAILED DESCRIPTION OF THE INVENTION AND PREFERRED EMBODIMENTS THEREOF

Figure 1:
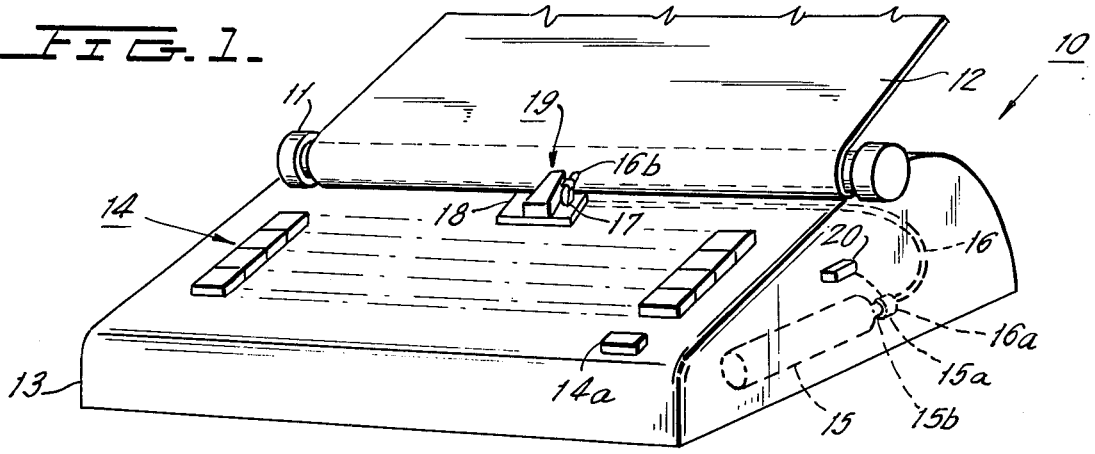
FIG. 1 is a perspective view of a conventional keyboard printer which has been adapted to incorporate the erasure apparatus of the present invention.

FIG. 1 shows a typewriter, printer or other like device 10 provided with a platen 11 for supporting a paper document or sheet 12. The printer housing 13 is provided with a conventional keyboard 14 typically including alphabetic and numeric characters, as well as punctuation marks, symbols, and the like. The keyboard is also typically provided with function keys such as a tab key, advance key, back-space key, line feed key, carriage return key, and the like.

In addition to such function keys, there is provided an "ERASE" function key 14*a* which, when activated, causes the performance of an erasure operation to be more fully described.

The correction mechanism is further comprised of a container 15 (see also FIG. 2) which may, for example, be a spray type aerosol can containing a correction powder (i.e. dry) or liquid material maintained in the can under pressure and having much the same characteristics as a paint in that it is capable of adhering to the paper web that it is sprayed upon as well as portions of the paper web which have been printed upon by impacting an inked ribbon with a type font or other impact means or, alternatively, which may have been sprayed upon by ink or other suitable substances from an ink jet type of printer or, alternatively, which may have been printed upon by a dot-matrix impact printer. The material has the characteristics of being substantially the same color as the paper being sprayed and being quick drying and having an opaqueness quality sufficient to cover over ink which has been transferred to the paper, typically in the form of a character or symbol, so as to effectively create the same result as erasure of a character from the paper by conventional means, such as a rubber eraser.

The outlet end of the can is fitted with a combination spray head and actuator button 15*a* mounted upon a movable valve stem 15*b* and having a dispensing outlet or opening coupled to one end 16*a* of a thin lightweight flexible plastic tube whose outlet end 16*b* is mounted by means of a suitable bracket 17 (to be more fully described hereinbelow) which serves to position the outlet end 16*b* a small spaced distance from the paper document. The bracket is provided upon a carriage 18 upon which is also mounted a print head 19 which may, for example, be a dot-matrix type print head of the impact type, a print head of the ink jet type or may, for example, be a printing ball or drum of the impact type having characters arranged at predetermined positions around the periphery thereof and, in the case of the ball, being capable of being rotated about two mutually perpendicular axes to appropriately position the desired character to be printed in the print position. Thus, printing occurs by moving the carriage 18 across the paper document, which is maintained stationary, and printing characters or symbols, until a line of print is completed, at which time the document is advanced (line feed) and the carriage is then either returned to the left-hand margin (carriage return) or printing occurs for the next line by moving the print head from right to left.

Thus, the outlet end of the tube 16 moves together with the carriage and hence is always appropriately positioned to dispense a measured dosage of the contents of container 15 upon a predetermined region of the paper 12 as will be described hereinbelow.

The erasure device of the present invention may also be utilized with typewriters of the moving platen type wherein the bracket 17 may be supported upon a stationary member of the typewriter and the platen may be of the type which is mechanically moved during typing so that each character is formed at the same exact position, typically at the center of the typewriter, and the platen is adapted to move past the printing position in incremental steps to form each character at successive positions along the paper.

The erase or correction key 14*a* is electrically connected, by means to be more fully described, to the electromechanical circuitry 20 which is responsive to the depression of key 14*a*, to impart a mechanical movement to the combined dispenser and spray button 15*a* in order to release the pressurized contents of container 15.

The contents pass through the now open valve means (not shown), spray head 15*a* and tube 16 to be sprayed upon a region of the paper 12 immediately adjacent the outlet end 16*b* of tube 16.

Figure 4A:
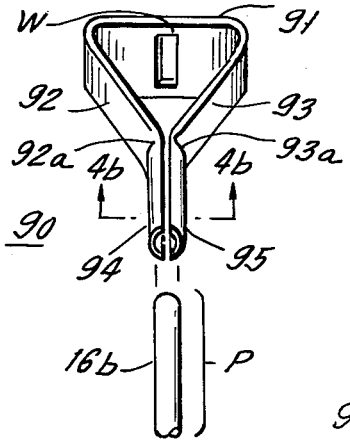
FIGS. 4*a*, 4*c* and 4*d* show perspective views
Figure 4B:
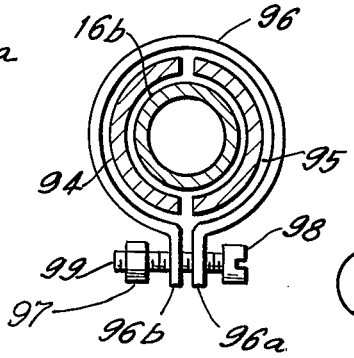
FIG. 4*b* shows a sectional view, of a mask and tube employed in the correction units of the present invention.
Figure 4C:
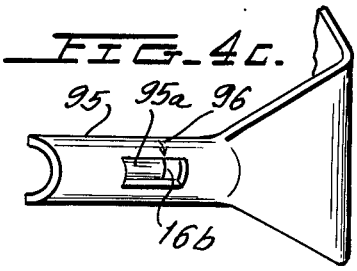
Figure 4D:
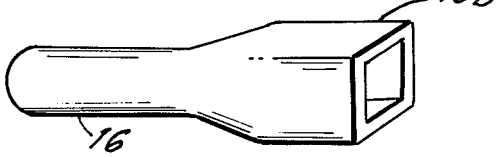

The outlet end 16*b* of tube 16 may be formed in the manner shown in FIG. 4*d* as to have a substantially rectangular cross-section in order to cover a substantially similar shaped region on sheet 12. Alternatively, or in addition thereto, a mask (to be more fully described) may be utilized to further limit the region of the paper 12 to be sprayed.

Figure 2:
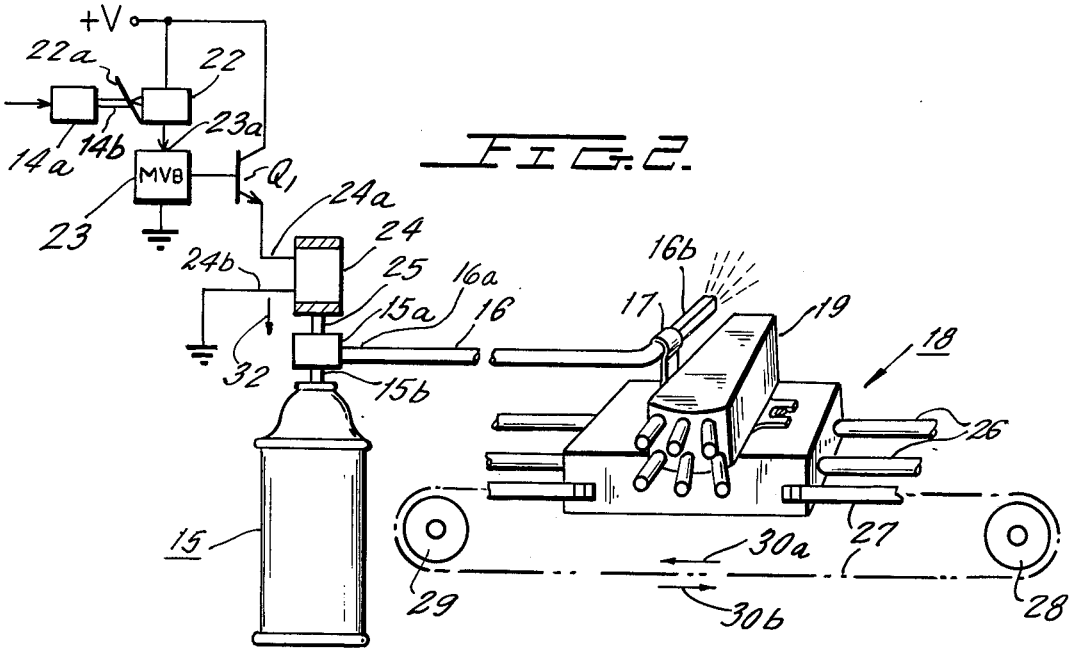
FIG. 2 shows a combined perspective and schematicized view of the most significant elements of the erasure apparatus of the present invention.

FIG. 2 shows the major components of the erasure device, wherein the button 14*a* is shown as having an arm 14*b* for engaging the movable arm 22*a* of a normally open microswitch 22. The microswitch is maintained normally open by a suitable bias means (not shown) and is coupled between a voltage source +V and the trigger or control input 23*a* of one-shot multivibrator 23. The output of multivibrator 23 is coupled to the base electrode of transistor Q1 whose collector is coupled to voltage source +V and whose emitter is coupled to one coil terminal 24*a* of a plunger type solenoid 24, whose opposite coil terminal 24*b* is coupled to ground or reference potential. The plunger or armature 25 of solenoid 24 is coupled to or otherwise engages the combination spray head and actuation button 15*a* mounted upon the valve stem 15*b* of aerosol container 15. The outlet opening of head 15*a* receives one end of tube 16 whose opposite end is mounted upon carriage 18 by means of bracket 17. A print head 19 of the dot-matrix type is shown as being mounted upon carriage 18. The carriage is guided along a linear path by means of a pair of guide rods 26 whose opposite ends are secured to the typewriter frame (not shown). A timing belt 27 is entrained about drive pulley 28 and idler pulley 29. A suitable motor (not shown) rotates drive pulley 28 selectively in either the clockwise or counterclockwise direction so as to impart movement to carriage 18 in the direction of arrow 30A and 30B, respectively.

The operation of the correction apparatus is as follows:

By depressing key 14*a*, normally open microswitch 22 is closed to apply an activating signal to one-shot multivibrator 23. The output of the one-shot 23 is a square pulse of a predetermined time interval. The presence of the square pulse causes transistor Q1 to conduct to energize solenoid 24 over the duration of the square pulse. Plunger or armature 25 of the solenoid is moved in the direction shown by arrow 32 to likewise move button 15*a* downwardly causing the pressurized contents to be released through an opening (not shown) in head 15*a* and through tube 16 to be sprayed upon the paper document over a region more than sufficient to cover the erroneously printed character, it being understood that the carriage has been moved to the proper position for "erasure".

The termination of the square pulse renders transistor Q1 non-conductive, thereby deenergizing solenoid 24 and causing the depressible operating button 15*a* to return to its normal position under control of a suitable biasing element (not shown for purposes of simplicity) thereby causing a measured dose of the pressurized correction material to be dispensed.

The one-shot multivibrator may be replaced by a delay circuit comprised of a normally deenergized free-running multivibrator and counter and decoder whose output remains high through a predetermined count whereby the operating frequency of the free-running multivibrator and the counter may be adjusted to provide any desired time interval. The free-running multivibrator is energized by closure of button 14*a*, causing pulses to be applied to the counter at a predetermined rate. The counter accumulates counts from zero to capacity. The decoder is coupled to selected output stages of the counter to maintain Q1 energized over a predetermined time interval. Such a timing circuit may be a solid state circuit of the 555 type.

As another alternative, the aerosol container may be fitted with an internally mounted valve mechanism of the type, for example, as described in U.S. Pat. No. 2,968,427 wherein once the member 15*a* is depressed, a measured dosage is dispensed regardless of the length of time that the button 15*a* is maintained in the depressed position. In such an embodiment, the output of microswitch 22 may either be directly connected to the input 24*a* of solenoid 24 or directly connected to the base electrode of transistor Q1 whereupon depressing key 14*a* either directly energizes solenoid 24 or causes Q1 to conduct thereby energizing solenoid 24 to depress button 15*a* thereby dispensing a measured amount of the pressurized material. The preferred embodiment is nevertheless that one which utilizes at least a crude or coarse delay interval which may either be in the form of the multivibrator described hereinabove or a slow-to-release solenoid 24 or a slow-to-release button 14*a*, and which provides a delay sufficient to allow the measured dosage of correction material to be dispensed.

The bracket assembly 17, utilized for securing the free end of tube 16, is shown in FIGS. 3*b* and 3*c* as being comprised of first and second L-shaped brackets 37 and 38, each having feet 37*a* and 38*a* for mounting upon the carriage 18, to be more fully described, by fasteners 39. The upright arms 37*b* and 38*b* are each provided with elongated openings, such as, elongated opening 37*d* for cooperating with openings in tube gripping elements 40 and 41 having lower portions such as 41*a* provided with an opening 41*b* to be aligned with the openings in support brackets 37 and 38, and having a generally semicircular shaped curved portion 40*c* and 41*c* terminating in an upper straight portion 40*d* and 41*d*. A fastening element such as a threaded bolt 43 is passed through the four coaligned openings and is threadedly engaged by nut 44 to tighten the aforesaid elements. The cooperating semicircular shaped portions 40*c* and 41*c* collectively have an inner diameter which is preferably slightly less than the outer diameter of the tube so as to firmly grip the tube (without closing or pinching the interior) when the fastening elements 43 and 44 are tightened. As can best be seen from FIG. 3*c*, the upper elements 40 and 41 may be swung about the fastening element 43 to provide an additional adjustment feature. By providing elongated openings 37*d* and 38*d* in bracket arms 37*c* and 38*c*, an upward or downward adjustment in the vertical direction is facilitated.

In order to precisely adjust the bracket a spaced distance from the platen and to further provide an adjustment leftwardly or rightwardly along a line parallel to the longitudinal axis of the platen, the adjustable assembly 50 may be utilized upon the carriage 18.

As shown, there is provided a pair of L-shaped brackets 51 and 52 mounted upon a portion of carriage 18 and adapted to slidably glide a block 53 therebetween. An upright projection 54 receives a threaded member 55 rotatable within an opening and threadedly engaging a tapped opening 53*a* in block 53. Threaded member 55 is free to rotate about its longitudinal axis within the opening in upright 54, but experiences no linear movement whatsoever. However, upon rotation thereof, its threaded engagement with tapped aperture 53*a* causes the slidably mounted plate 53 to be moved in a direction shown by arrow 55 or by arrow 56, depending upon the direction which threaded member 55 is rotated. This enables the block 53 to be adjustably moved clear toward or further away from the platen 11.

Mounted upon block 53 are a pair of L-shaped brackets 56 and 57 slidably supporting block 58 and having a threaded opening (not shown) adapted to receive threaded member 59 rotatably supported within a suitable opening provided in upright 60 mounted on block 53. A portion of L-shaped bracket 51 has been removed to facilitate access to the head 59*a* of threaded member 59 by means of an adjusting tool such as, for example, the head of a screwdriver. By rotation of threaded member 59, it is thus possible to move block 58 either to the left or to the right as shown by arrows 62 and 63. Bracket 17 is mounted upon block 58 and by the means described hereinabove the outlet end of the tube may be adjusted four separate and independent ways, i.e. by adjustment of blocks 53 and 58, by adjustment of elements 40 and 41 in either the upward or downward vertical direction and by pivotal adjustment of elements 40 and 41 about the axis of fastening member 43. As was mentioned hereinabove, the bracket and support elements 37 and 38 may be positioned diagonally relative to platen 11 so as to direct the spray diagonally toward the region occupied by the character to be removed. If desired the fastening elements 43 and 44 may be threaded through openings in bracket arms 37*c* and 38*c* provided below the upper ends thereof. The upper ends of arms 37*c* and 38*c* and the lower ends of elements 40 and 41 may be formed in hemispherical shape to cooperatively form a socket (37*c* and 38*c*) and a ball (40,41) fitting into said socket, thereby providing rotational adjustment of the tube in two mutually perpendicular directions.

As an alternative arrangement, the spray need not be obliquely directed and may, in turn, be directed at a right angle toward platen 11 and hence toward a mask M comprised of a preferably light-weight substantially rigid or semi-rigid member having a window W formed therein. The lower end of mask M may be secured to carriage 18 by fastening elements 70 and 71. The window may be positioned immediately over the character to be removed and a centering indicia 73 may be provided along the upper edge of window W to facilitate in assuring the alignment of the window over the character or symbol to be removed.

If desired, similar indicia 73*a*–73*c* may be provided along all of the remaining margins of window W. In this fashion, the mask which is positioned immediately adjacent the paper document, serves to limit the size of the region being sprayed by the pressurized correction material. The dimensions of the mask M are chosen so as to be small enough so as to obscure a minimum number of characters and yet large enough so as to be assured to prevent the material being sprayed from the outlet end 16*b* of tube 16 from striking paper 12 at any place other than the region within window W. The mask M is obviously adjusted so that window W is exactly centered or aligned with characters printed by the print head and the dispensing end of tube 16 is also adjusted accordingly to spray an area slightly greater than the area defined by window W.

In embodiments in which the invention is utilized with a linearly movable platen, the bracket 17 is fixed upon a stationary element of the printer or typewriter. However, in embodiments utilizing prints heads mounted upon movable carriages, the outer end 16*b* of tube 16 moves together with the carriage and hence moves either closer toward or further away from the aerosol container 15. In such cases, the tube must be of a length sufficient to permit the carriage to move to the extreme left-hand margin of the paper document 12 to permit both a printing and a correction operation. In such cases, when the carriage moves from the left-hand margin toward the right-hand margin, it is desired that means be provided for taking up the slack which will otherwise develop in the tube. This may be accomplished through the embodiment shown in FIGS. 5*a* and 5*b* wherein the tube may be precoiled during manufacturing so as to form a relatively tight helical configuration as shown in FIG. 5*b* when the carriage 18 and hence the outlet end 16*b* of tube 16 is at the extreme right-hand margin of the typewriter. As the carriage moves to the left-hand margin, the helically coiled tube stretches or expands as shown in FIG. 15*a*, enabling the tube to stretch to the left-hand margin. When the carriage returns toward the right-hand margin, the plastic memory of the tube causes it to contract to the tight helical coil of FIG. 5*b*.

If desired, a sleeve S in the form of a very light flexible fabric may be positioned around the helically coiled tube. A reenforcing metallic coil C formed of a thin wire may be utilized to confine the helically coiled tube 16 within sleeve S so as to prevent it from being displaced in a lateral direction from the region of the flexible sleeve S. The coil C may be secured about the tube near the end positions as shown at C1 and C2.

As an alternative arrangement, the tube may be wrapped around a spool 80 mounted to rotate freely upon shaft 81 whose ends are secured to a suitable portion of the printer framework. A helical or torsion type spring 82 is wound about shaft 81 and has a first end 82*a* secured to shaft 81 by a pin 83 and has its opposite end 82*b* secured to one end of spool 80 by pin 84. Spring 82 normally urges spool 80 to rotate in the direction shown by arrow 85 so as to wind tube 16 about the spool. When the carriage moves toward the left-hand margin, the force exerted upon tube 16 by the bracket assembly 17 is more than sufficient to overcome the rewinding force of spring 82, allowing the tube to unwind an amount sufficient to enable the carriage to freely move to the left-hand margin of the paper sheet 12. As the carriage moves toward the right-hand margin, spring 82 causes spool 80 to rotate in the direction shown by arrow 85 causing the tube to be rewound about the spool.

As another alternative embodiment, the correction structure of the present invention may be a stand-alone structure comprised of container 15 fitted with a valve assembly of the type described hereinabove for dispensing a measured quantity. One end of tube 16 is fitted to the outlet end of the spray element 15*a* (see FIG. 2) while the opposite end 16*b* is fitted within a bracket assembly 90 shown in FIGS. 4*a* and 4*b* and comprised of a yoke portion 91 having a pair of inwardly bent arms 92 and 93 which are bent diagonally relative to yoke portion 91 so as to converge toward one another. The opposite free ends are bent outwardly at 92*a* and 93*a*, respectively, to form the outer free ends 94 and 95 which, are bent or otherwise formed in a semi-circular configuration so as to embrace a portion P of the end 16*b* of tube 16. The inner diameter of the arms 94 and 95 is preferably slightly less than the outer diameter of tube 16 so as to firmly grip the tube therebetween. A clamp 96 is positioned to embrace the outer peripheries of free ends 94 and 95 and has an inner diameter slightly less than the outer diameter of members 94 and 95 so as to firmly grip members 94 and 95 therebetween and cooperate to grip the tube end 16*b* therein.

A bolt 98 is passed through suitable openings in the free arms of 96*a* and 96*b* of clamp 96 and a nut 97 serves to tighten clamp 96 about the free ends 94 and 95 to tightly grip the free end 16*b* of tube 16 within the bracket assembly 90. Each of the arms 94 and 95 is provided with a slot such as, for example, the slot 95*a* shown in arm 95. A marker or other indicia 96 is provided to facilitate location of the extreme end 16*b* of tube 16 so as to reasonably accurately locate the outlet end of the tube relative to the window W provided in the yoke portion 91. This positioning assures the spray emitted from the outlet end 16*b* of tube 16 will be sufficient to cover and at least slightly overlap the marginal edges of window W. The bracket 90 may be positioned upon the paper sheet with the window immediately over the printed character or symbol to be erased. The spray button 15*a* is then depressed causing a measured amount of the spray material to be dispensed from end 16*b* of tube 16, window W controlling the region over which the material is dispensed. This assembly enables the unit to be utilized as an independent stand-alone unit with existing printers or typewriters thus eliminating the need for any retrofitting operations.

If desired, the dispensing unit may be of the standard type in which the valve assembly provided in the aerosol is not of the measured dosage type.

The correction material in the pressurized container may be either of a dry powder form or liquid form and may be provided in any color in order to match the color of the paper sheets being printed upon.

As a substitute for the aerosol type containers, a reservoir may be provided with a predetermined amount of the correction material and a suitable pump may be provided to provide pressure sufficient to pump the liquid into the tube for spraying upon the paper sheet 12.

Although there has been described a preferred embodiment of this novel invention, many variations and modifications will now be apparent to those skilled in the art. Therefore, this invention is to be limited, not by the specific disclosure herein, but only by the appending claims.

What is claimed is:

1. Apparatus for applying characters to a sheet of paper, including means for correcting errors, said apparatus including:

supporting means comprising a platen for supporting a sheet of paper;

printing means mounted for movement adjacent to said supporting means for selectively applying characters to said sheet of paper;

a pressurized source of correction fluid;

a hollow flexible tube having a first and a second end, said first end being connected to said source of pressurized correction fluid, said second end being mounted to move with said printing means to selectively apply said correction fluid to said sheet of paper; and coiling means responsive to movement of said printing means for coiling said hollow flexible tube.

2. Apparatus for applying characters to a sheet of paper, including means for correcting errors, said apparatus including:

supporting means comprising a platen for supporting a sheet of paper;

printing means mounted for movement adjacent to said supporting means for selectively applying characters to said sheet of paper;

a pressurized source of correction fluid;

a hollow flexible tube having a first and a second end, said first end being connected to said source of pressurized correction fluid, said second end being mounted to move with said printing means to selectively apply said correction fluid to said sheet of paper; and wherein said hollow flexible tube is an elongated tube performed in an helical formed fashion and having a plastic memory suitable to enable said tube to return to the tightly helical coiled configuration when the expanded tube is released.

* * * * *

UNITED STATES PATENT AND TRADEMARK OFFICE

CERTIFICATE OF CORRECTION

PATENT NO. : 4,120,594

DATED : October 17, 1978

INVENTOR(S) : Robert Howard

It is certified that error appears in the above-identified patent and that said Letters Patent are hereby corrected as shown below:

Column 6, Line 52 the word "clear" should read --closer--

Column 7, Line 49 the word "outer" should read --outlet--

Column 7, Line 67 the word "15a" should read --5a--

Signed and Sealed this

*Eighth* Day of *May 1979*

[SEAL]

*Attest:*

RUTH C. MASON
*Attesting Officer*

DONALD W. BANNER
*Commissioner of Patents and Trademarks*